US005554963A

United States Patent [19]

Johler et al.

[11] Patent Number: 5,554,963

[45] Date of Patent: Sep. 10, 1996

[54] GAS-FILLED PLASTIC ENCLOSED RELAY

[75] Inventors: Werner Johler, Au; Werner Kälin, Rickenbach, both of Switzerland

[73] Assignee: Alcatel STR AG, Zurich, Switzerland

[21] Appl. No.: 384,692

[22] Filed: Feb. 6, 1995

Related U.S. Application Data

[63] Continuation of Ser. No. 73,431, Jun. 9, 1993, abandoned.

[30] Foreign Application Priority Data

Jun. 11, 1992 [CH] Switzerland ..... 01851/92

[51] Int. Cl.[6] ..... H01H 51/00; H01H 9/30

[52] U.S. Cl. ..... 335/151; 335/201; 218/1; 200/302.1

[58] Field of Search ..... 174/52.3; 200/144 R–144 AP, 200/302.1–302.3, 306, 293; 335/128, 151, 189–204; 218/1, 43, 85

[56] References Cited

U.S. PATENT DOCUMENTS

| | | | |
|---|---|---|---|
| 3,411,118 | 11/1968 | Fellows et al. | 335/151 |
| 3,662,194 | 5/1972 | Moriki et al. | 310/9.4 |
| 3,889,076 | 6/1975 | Olsen et al. | 200/48 R |
| 4,039,984 | 8/1977 | DeLucia et al. | 335/151 |
| 4,168,480 | 9/1979 | De Lucia | 335/151 |
| 4,259,652 | 3/1981 | Mattson | 335/128 |
| 4,309,816 | 1/1982 | Takeyama et al. | 200/302.1 X |
| 4,338,501 | 7/1982 | Maggi | 218/26 |
| 4,353,048 | 10/1982 | DeLucia | 335/151 |
| 4,427,863 | 1/1984 | Fujita | 200/306 |
| 4,506,244 | 3/1985 | Jabagchourian et al. | 335/151 |
| 4,580,005 | 4/1986 | Minks et al. | 174/52 S |
| 4,617,542 | 10/1986 | Lutz et al. | 335/196 |
| 4,625,191 | 11/1986 | Oberndorfer et al. | 335/78 |
| 4,638,275 | 1/1987 | Belbel et al. | 335/151 |
| 4,675,987 | 6/1987 | Minks et al. | 29/602.1 |
| 4,698,469 | 10/1987 | Pham et al. | 218/83 |
| 4,700,270 | 10/1987 | Munzinger et al. | 200/148 R X |
| 4,761,627 | 8/1988 | Bell | 335/128 |

FOREIGN PATENT DOCUMENTS

| | | | |
|---|---|---|---|
| 0026231 | 1/1979 | European Pat. Off. | H01H 9/02 |
| 118841 | 9/1984 | European Pat. Off. | H01H 50/02 |
| 0130500 | 1/1985 | European Pat. Off. | H01H 50/02 |
| 0434463 | 12/1990 | European Pat. Off. | H01H 51/29 |
| 2437219 | 4/1980 | France | H01H 50/58 |
| 2226627 | 12/1973 | Germany | H01H 33/22 |
| 1267921 | 10/1989 | Japan | H01H 50/00 |
| 917479 | 2/1963 | United Kingdom . | |
| 1524404 | 9/1978 | United Kingdom | H01H 1/66 |
| 2032279 | 9/1982 | United Kingdom | H01H 51/06 |
| 2239354 | 6/1991 | United Kingdom | H01H 50/02 |

*Primary Examiner*—J. R. Scott
*Attorney, Agent, or Firm*—Spencer & Frank

[57] ABSTRACT

A relay includes a plastic enclosure, contacts disposed in the plastic enclosure for selectively operating to make and/or break at least one electrical connection, a gas filling containing at least one electronegative gas, and a sealed plastic encapsulation for preventing the at least one electronegative gas from diffusing away, whereby the dielectric strength of the at least one electronegative gas is maintained throughout the intended life of the relay.

4 Claims, 1 Drawing Sheet

GAS-FILLED PLASTIC ENCLOSED RELAY

This application is a continuation of application Ser. No. 08/073,431, filed Jun. 9, 1993 (now abandoned).

BACKGROUND OF THE INVENTION

1. Field of the Invention

The field of the present invention lies within the art relating to enclosed switches, and the invention concerns gas-filled enclosed relays, particularly a plastic-encapsulated relay for mounting on printed-circuit boards.

2. Background Information

Developments in relay construction are aimed, inter alia, at increasing efficiency and, thus, either reducing the relay size or improving the electrical characteristics. A significant volume reduction for high-voltage and extra-high-voltage enclosed switch gear is known, which is realizable practically only by filling the enclosures with an electronegative gas, e.g., $SF_6$. To further increase the dielectric strength, a pressure higher than the normal atmospheric pressure is generally used and any leakage losses are compensated for by refilling. A reduction of the lower operating temperature due to an increase in the evaporation temperature of the filler gas as a result of the increased pressure is not a major factor, because such switch gear is usually operated in rooms with a sufficiently high minimum temperature.

In all prior art installations where the enclosures are filled with an electronegative gas to increase the dielectric strength, either any leakage losses of the enclosures are compensated for, or the enclosures hermetically sealed, e.g., practically leakage-free metal-glass enclosures are employed.

In the case of a plastic-encapsulated relay, however, which is to be produced at low cost, is to have a small volume, and is to be mounted on printed-circut boards, for example, this category of enclosure is not realizable; and leakage compensation is just as unsuitable. For low-cost relays for printed-circuit boards, only a tight plastic enclosure can be provided.

Plastic-encapsulated relays for printed-circuit boards are known, including gas-filled relays, in which an inert gas is generally used to enhance contact reliability. The inert gas is introduced through specific openings which are closable after the filling operation. One example is the washable relay disclosed in DE-A-3323922 (U.S. Pat. No. 4,580,005). This does not result in a significant increase in dielectric strength, however.

On the one hand, more stringent safety requirements placed on relays necessitate a higher dielectric strength, and on the other hand, smaller relay sizes are desired because of the higher component density in printed circuits. A worthwhile goal for improving performance capability is therefore to increase the dielectric strength with unchanged dimensions or to maintain the dielectric strength despite significantly smaller dimensions.

SUMMARY OF THE INVENTION

It is, therefore, the object of the present invention to provide a relay which can be made at low cost and has a higher dielectric strength than can be achieved with a relay of identical construction whose interior is filled with dry air or an inert gas. The relay is to be suitable for applications as are contained in contact application categories 0, 1, 2 and 3 of IEC Standard 255-7,and as can be found mainly in telecommunications.

This object is attained by a relay having a plastic enclosure, contact means disposed in the plastic enclosure for selectively operating to make and/or break at least one electrical connection, a gas filling containing at least one electronegative gas, and a sealed plastic encapsulation for preventing the electronegative gas from diffusing away, whereby dielectric strength of the at least one electronegative gas is maintained throughout the intended life of the relay.

Under atmospheric or slightly increased pressure, the electronegative gas is able to increase the dielectric strength as compared with dry-air or inert-gas fillings to a sufficient extent. For fillings under normal pressure, plastic enclosures and sealedplastic encapsulations are sufficient to limit leakage losses. The matching of the types of plastics and aas used and of their sealing prevents any nonpermissible diffusion loss of the electronegative gas. A specified dielectric strength is thus maintained throughout the life of the relay. Compared with known relays, smaller relays with equally high dielectric strength or relays of the same size with higher dielectric strength can be manufactured.

BRIEF DESCRIPTION OF THE DRAWING

Further advantageous features of the relay according to the invention will become apparent from the detailed description taken with the accompanying FIGURE which shows a relay according to the invention.

DETAILED DESCRIPTION OF THE PREFERRED EMBODIMENTS

Figure 1:
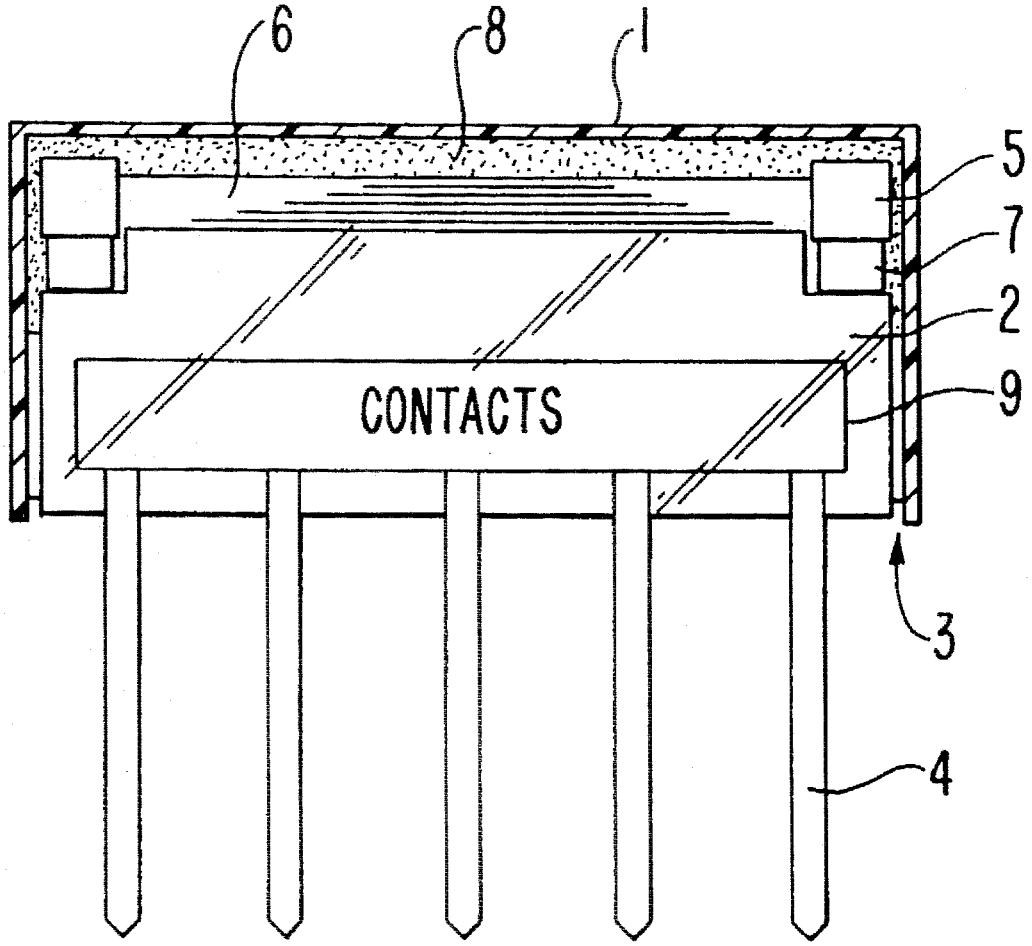

Peculiarities of the invention will now be explained in some more detail.

The advantages of electronegative gases with respect to the dielectric strength of contacts are apparent in enclosed high-voltage switch gear. However, the sophisticated technology available there cannot readily be applied to other applications, where different boundary conditions frequently exist. Miniature relays for use on printed-circuit boards, for example, must be mass-producible and suitable for use at temperatures down to far below 0° C. Viewed from this standpoint, a hermetically sealed enclosure is prohibitively expensive. Furthermore, high pressure as is usual in $SF_6$-insulated switch gear results in nonpermissible condensation of the gas already at moderate temperatures.

This is where the invention sets in, aiming to increase the dielectric strength by adequate means, taking into account the boundary conditions. The advantages of electronegative gases 8 are utilized, but not to the full extent, i.e., not by use under greatly increased pressure, but under atmospheric pressure. This provides only a partial increase of the dielectric strength, which, however, is sufficient for the respective application provided that the gas 8 can be effective throughout the intended life of the relay (FIG. 1). Since normal pressure is used, a hermetically sealed encapsulation can be dispensed with. An enclosure (1, 2) made of low-cost plastics without connection to the outside air is sufficient. According to the invention, it is also possible, of course, to use a slightly increased pressure of the gas filling 8 up to approximately 1.5 bar. The permissible pressure is only determined by the fact that no special steps have to be taken for the encapsulation to be able to maintain the partial pressure of the electronegative gas 8 throughout the life of the relay.

The known technique involving the use of inert gas serves mainly to ensure an uncontaminated starting atmosphere. Inert gas, such as nitrogen or argon, then diffuses through the plastic at a similar rate as water vapor or oxygen. For the outside air diffusing into the interior of the enclosure by way of compensation, the plastic acts as a microfiLter, so that no contamination will occur.

With the increase of the dielectric strength through the electronegative gas in accordance with the invention, things are different. Electronegative gases, depending on the type, have a relative breakdown strength which is up to five times higher than that of air. Already a gas with a relative breakdown strength of 2.5 provides a sufficient increase of the dielectric strength in the sense of the invention. The electronegative gas 8 must be preserved in the interior of the enclosure (1, 2) in a sufficient concentration. To this end, plastics will be selected whose structure nearly completely holds back the molecules of the electronegative gas 8. As a rule, the molecules of the electronegative gas are larger than those of air and of inert gases, which extends the range of suitable plastics. Due to the diffusion properties of all gases with respect to the plastics used, the composition of the gas filling 8 changes after the manufacture of the relay, but the concentration of electronegative gas 8 remains high enough to ensure a specified dielectric strength.

The use of a gas filling under normal pressure not only reduces the requirements placed on the enclosure (1, 2) but also extends the range of enclosure materials to choose from. As is well known, during the life of gas-filled relays, changes in the filling result not only from leakages, but also from diffusion losses through the enclosure. The relatively expensive and difficult-to-handle metal enclosures are very well suited to overcoming this problem. Plastic encapsulations are much lower in cost. Without suitable matchino of the plastic and the electronegative gas, however, the latter will diffuse away too rapidly, so that during the life of the relay, the dielectric strength will drop below the specified value. The plastics used for the encapsulation must therefore be optimized with regard to the diffusion properties of the filler gas.

A proven, well investigated and, therefore, preferred electronegative gas is sulfur hexafluoride, $SF_6$. It can be used in the form of technically pure $SF_6$ as the sole filler gas. A mixture of gases can provide improvements, e.g., with respect to the thermal characteristic. Preferably, one of the gases of such a mixture is again $SF_6$.

The proposed measures in combination thus allow a relay with improved properties regarding dielectric strength to be manufactured at low cost in a similar manner as heretofor. Thus, compared with the dielectric strength attainable with a relay whose interior is filled with dry air or an inert gas, either a higher dielectric strength can be achieved with unchanged relay dimensions or smaller relay dimensions can be realized with unchanged dielectric strength.

In the drawing, FIG. 1 is a schematic showing of a relay according to the invention, the front wall of the top cover and the sealing mass between it and the bottom part being cut away.

In the drawing, there is shown a cover top 1, a cover bottom 2 which corresponds to the contact set, a sealing mass 3, connecting pins 4, part of the coil former 5, a coil 6, part of the yoke 7, and a gas filling 8. Relay contacts are illustrated as a block 9 labelled "CONTACTS."

We claim:

1. A gas-filled plastic enclosed relay for mounting on printed-circuit boards, comprising:

a relay in an irreversibly sealed plastic enclosure, having a gas filling under a pressure of less than 1.5 bar, wherein the gas filling comprises at least one electronegative gas; and wherein the sealed plastic enclosure encapsulates the relay and gas filling, and acts as a micro-filter matched to the at least one electronegative gas, preventing the electronegative gas which is under a pressure of less than 1.5 bar, from diffusing away over a predetermined lifetime of the relay, so that the partial pressure of the at least one electronegative gas, and thus an increased dielectric strength, are maintained to a sufficient extent.

2. A gas-filled plastic-enclosed relay for mounting on printed-circuit boards as claimed in claim 1, wherein the at least one electronegative gas comprises technically pure $SF_6$.

3. A gas-filled plastic-enclosed relay for mounting on printed-circuit boards as claimed in claim 1, wherein the at least one electronegative gas comprises a mixture of at least two gases.

4. A gas-filled plastic-enclosed relay for mounting on printed-circuit boards as claimed in claim 3 wherein one of the at least two gases is $SF_6$.

* * * * *